US010088252B2

(12) United States Patent
Den Boer et al.

(10) Patent No.: US 10,088,252 B2
(45) Date of Patent: Oct. 2, 2018

(54) HEAT TRANSFERRING ARRANGEMENT

(71) Applicant: PHILIPS LIGHTING HOLDING B.V., Eindhoven (NL)

(72) Inventors: Reinier Imre Anton Den Boer, Eindhoven (NL); Juan David Bernal, Eindhoven (NL); Kwan Nai Lee, Eindhoven (NL); Vincent Stefan David Gielen, Eindhoven (NL); Merijn Keser, Eindhoven (NL)

(73) Assignee: PHILIPS LIGTING HOLDING B.V., Eindhoven (NL)

( * ) Notice: Subject to any disclaimer, the term of this patent is extended or adjusted under 35 U.S.C. 154(b) by 90 days.

(21) Appl. No.: 14/373,046

(22) PCT Filed: Jan. 20, 2013

(86) PCT No.: PCT/IB2013/050516
§ 371 (c)(1),
(2) Date: Jul. 18, 2014

(87) PCT Pub. No.: WO2013/108236
PCT Pub. Date: Jul. 25, 2013

(65) Prior Publication Data

US 2014/0369039 A1 Dec. 18, 2014

Related U.S. Application Data

(60) Provisional application No. 61/620,479, filed on Apr. 5, 2012, provisional application No. 61/588,737, filed on Jan. 20, 2012.

(51) Int. Cl.
*F21V 29/74* (2015.01)
*F28F 21/06* (2006.01)
(Continued)

(52) U.S. Cl.
CPC ..... *F28F 21/06* (2013.01); *F21K 9/23* (2016.08); *F21V 29/74* (2015.01); *F21V 29/503* (2015.01); *F21Y 2115/10* (2016.08)

(58) Field of Classification Search
CPC .. F21V 19/0035; F21V 29/505; F21V 29/717; F21V 29/74; F21V 29/745;
(Continued)

(56) References Cited

U.S. PATENT DOCUMENTS 4,028,542 A * 6/1977 McReynolds, Jr. ..... F21V 7/06 362/297
7,637,628 B2 * 12/2009 Budike ..... 362/247
(Continued)

FOREIGN PATENT DOCUMENTS

CN 201059513 Y 5/2008
CN 101876427 A 11/2010
(Continued)

*Primary Examiner* — Jong-Suk (James) Lee
*Assistant Examiner* — Zheng Song
(74) *Attorney, Agent, or Firm* — Akarsh P. Belagodu

(57) ABSTRACT

The present invention relates to a heat transferring arrangement (100, 400) for cooling at least one light emitting diode (302), wherein the heat transferring arrangement (100, 400) comprises a centre portion (102, 402) configured for mounting the light emitting diode (302) and adapted to receive heat generated from the light emitting diode (302) when emitting light, and a plurality of elongated heat transferring elements (104), each having a first end portion (106) connected to the center portion (102, 402) and a second end portion (108) which when inserted in a housing (200) is configured to be in abutment with an inner surface (202) of the housing (200), so that the generated heat is thermally transferred to the housing (200). Advantages with the invention includes, at least, that a passive heat transferring arrangement is pro-
(Continued)

vided which may reduce the need of an external fan or membranes to provide sufficient cooling.

1 Claim, 6 Drawing Sheets

(51) Int. Cl.
*F21K 9/23* (2016.01)
*F21V 29/503* (2015.01)
*F21Y 115/10* (2016.01)

(58) Field of Classification Search
CPC ..... F21V 29/763; F21V 29/85; F21V 7/0066; F21V 7/06; F21V 7/07; F21V 7/08; F21V 7/16; F21V 7/18; F21V 7/22; F21V 29/503505; F28F 21/06
USPC ..... 362/294, 373, 345, 249.02
See application file for complete search history.

(56) References Cited

U.S. PATENT DOCUMENTS

2005/0111234 A1* 5/2005 Martin ..... F21S 6/003 362/555
2008/0055910 A1* 3/2008 Goverde ..... 362/294
2009/0323325 A1* 12/2009 Long ..... F21K 9/00 362/234
2010/0102694 A1* 4/2010 Shin ..... 313/1
2010/0133578 A1* 6/2010 Pickard et al. ..... 257/99
2010/0188860 A1* 7/2010 Liaw ..... F21V 29/004 362/373
2011/0050070 A1 3/2011 Pickard
2011/0074265 A1 3/2011 Van De Ven
2011/0193467 A1* 8/2011 Grajcar ..... 313/113
2011/0267821 A1* 11/2011 Van De Ven et al. ... 362/249.02
2012/0092870 A1* 4/2012 Tralli et al. ..... 362/249.02
2012/0140490 A1* 6/2012 Rowlette, Jr. ..... F21K 9/00 362/373
2012/0268937 A1* 10/2012 Lee ..... F21V 29/004 362/249.02
2013/0114251 A1* 5/2013 Duan ..... 362/235

FOREIGN PATENT DOCUMENTS

CN 202024184 U 11/2010
EP 2180249 A1 4/2010
WO WO2006013495 A2 2/2006
WO WO2011094166 A1 8/2011
WO WO2011100193 A1 8/2011

* cited by examiner

HEAT TRANSFERRING ARRANGEMENT

CROSS-REFERENCE TO PRIOR APPLICATIONS

This application is a U.S. national stage application under 35 U.S.C. § 371 of International Application No. PCT/IB2013/050516, filed on Jan. 20, 2013, which claims priority benefit under 35 U.S.C. § 119(e) of U.S. Provisional Application No. 61/588,737filed on Jan. 20, 2012 and U.S. Provisional Application No. 61/620,479 filed on Apr. 5, 2012, the contents of which are herein incorporated by reference.

TECHNICAL FIELD

The present invention relates to the field of heat management of light emitting diodes, and more specifically to a heat transferring arrangement for cooling a light emitting diode. The present invention also relates to a lighting assembly comprising the above heat transferring arrangement.

BACKGROUND OF THE INVENTION

Light emitting diodes, LEDs, are employed in a wide range of lighting applications. As LEDs have the advantage of providing a bright light, being reasonably inexpensive and has low power consumption, it is becoming increasingly attractive to use LEDs as an alternative to traditional lighting. Furthermore, LEDs have a long operational lifetime. As an example, LED lamps may last 50 000 hours which is up to 50 times the operational life of an incandescent lamp.

To achieve such a long operational lifetime, one important aspect to consider is the heat management of the LEDs so in order to avoid overheating of the LEDs or the LED module. This is not an uncomplicated task since LEDs release heat backwards, i.e. in the opposite direction compared to the direction of the light beams, in comparison to traditional lighting which mainly transfer the generated heat by the radiation of the light. Especially, when LEDs are mounted in, for example, roofs or ceilings it may become complicated to provide sufficient cooling due to the reduced surrounding space of the LEDs. Moreover, when for example using LEDs for indoor applications, such as accent and down lighting applications, there is a need for compact and high lumen packages which allows the projection of tight light beam angles. In such cases, a plurality of LEDs are placed together in a small area which provides such an amount of heat that a standalone heat sink may not be able to provide sufficient cooling.

A solution to this problem is to provide an active cooling element, such as e.g. fans or membranes, in order to provide a sufficient amount of cooling. However, these types of solutions are expensive and sometimes unreliable due to their limited operational lifetime. There is hence a further need of improvement in regards to heat management for LEDs.

SUMMARY OF THE INVENTION

It is an object of the present invention to provide an improved heat transferring arrangement for a light emitting diode in order to at least partly overcome the above mentioned problems.

According to an aspect of the present invention there is provided a heat transferring arrangement for cooling at least one light emitting diode, wherein the heat transferring arrangement comprises a centre portion configured for mounting the light emitting diode and adapted to receive heat generated from the light emitting diode when emitting light, and a plurality of elongated heat transferring elements, each having a first end portion connected to the centre portion and a second end portion which when inserted in a housing is configured to be in abutment with an inner surface of the housing, so that the generated heat is thermally transferred to the housing.

The present invention is based on the insight that a heat transferring arrangement may be provided which, when inserted in a housing, can transfer heat generated by the LEDs to the housing, i.e. the housing thus acts as a heat sink for the LED or LED module. Moreover, as the LED in many applications is arranged at a centre of the housing, i.e. far away from the inner surface of the housing, the present invention is also based on the insight that by providing elongated elements, connected to the centre portion of the heat transferring arrangement and extending in a direction towards the inner surface of the housing, heat generated by the LEDs may be thermally transferred to the housing when being mounted thereto as the second end portion, when mounted to the housing, is in abutment with the inner surface of the housing such that there is a thermal connection between the housing and the heat transferring arrangement. The heat transferred to the housing may thereafter be dissipating to the surrounding environment. An advantage of the invention is thus, at least, that a passive heat transferring arrangement is provided which may reduce the need of an external fan or membranes to provide sufficient cooling. Also, another advantage of the present invention is that already existing lighting luminaire and lamp housings, used for classic lighting technology, such as e.g. incandescent lighting, CFL, HID, etc may be used as a heat sink by providing the elongated heat transferring elements to the LED module, thereby enabling for an improvement with regard to interchangeability of LEDs and classic lighting technology, as well as a reduction of the need of an extra heat sink for heat management. The elongated heat transferring elements should in the following and throughout the entire description be interpreted as elements which, when being placed in abutment with e.g. an inner surface of the housing, can bend and adjust to the specific geometry of the housing.

The first end portion of the elongated heat transferring elements may be connected to the centre portion in a plurality of ways. For example, the first end portion may be integrated with the centre portion. Hereby, the elongated heat transferring elements and the centre portion may be provided from one and the same sheet of material, such as e.g. a sheet of aluminum or graphite. The first end portions may also be separately provided to the centre portion i.e. connected to the centre portion by a connecting means. Such connecting means may, for example, be a screw joint, a weld, glue, etc. In the case of connecting the first end portions of the elongated heat transferring elements to the centre portion by means of a connecting means, the first end portion or the positions of the centre portion intended to receive the end portions may be provided with a thermal interface material, which will be described further below. Hereby, the thermal conductive characteristics between the centre portion and the elongated heat transferring elements may be improved compared to not having a thermal interface material.

The expression "transfer heat" should in the following be interpreted as heat which is generated in the centre portion of the heat transferring arrangement and thereafter further transferred through the elongated heat transferring elements to the housing.

Moreover, the elongated heat transferring elements may preferably be made of a heat conductive material, such as aluminum. Other materials are of course conceivable such as for example copper or graphite, etc. Hence, it is an important aspect that the elongated heat transferring elements are susceptible for transferring heat in a desired manner when choosing material for the elongated heat transferring elements.

According to an example embodiment, the second end portions of the plurality of elongated heat transferring elements forms a geometric area which is larger than a cross sectional area of the inner surface of the housing, so that when the heat transferring arrangement is inserted in the housing, the plurality of elongated heat transferring elements are bended against the inner surface of the housing. The geometric area of the elongated heat transferring elements described above should be interpreted as a non-physical area delimited by the second end portions. For example, if the elongated heat transferring elements are formed on a generally circular centre portion, they may be curve-shaped and together form a flower-like configuration. In such a case, the geometric area is thus a substantially circular area delimited by the boundary of the second end portions and wherein the substantially circular area has a diameter that is larger than the diameter of the housing in which the heat transferring arrangement is adapted to be inserted in. On the other hand, if the elongated heat transferring elements are formed on a, for example, generally rectangular centre portion arranged for a generally rectangular housing, the second end portions of the elongated heat transferring elements may form a substantially rectangular geometric area, i.e. the geometric area is delimited by four "walls" formed by the second end portions of the elongated heat transferring elements. In the latter example, the area of the substantially rectangular area should hence be larger than the generally rectangular area of the housing. It is thus submitted from the above examples that the mutual configuration of the elongated heat transferring elements may be arranged differently depending on the specific housing in which the heat transferring arrangement is adapted to be fitted. It should however be noted that the rectangular form of the geometric area described above may be equally provided for a generally cylindrical centre portion, and vice versa. The above examples are only described for clarification.

An advantage of providing the above mentioned geometric area of the second end portions larger than the cross sectional area of the housing is, at least, that when the heat transferring arrangement is provided in the housing, the elongated heat transferring elements will be in contact with the inner surface of the housing and at the same time be slightly bended in relation to their previous configuration. A compression force between the second end portions of the elongated heat transferring elements and the inner surface of the housing will thus arise, i.e. the second end portions of the elongated heat transferring elements will be in abutment with the inner surface of the housing when assembled thereto, thereby enabling the heat to be transferred through the elongated heat transferring elements to the housing.

Moreover, the second end portions of the plurality of elongated heat transferring elements may comprise a thermal interface material having a lower friction coefficient than the remaining parts of the elongated heat transferring elements. Hereby, the interface between the elongated heat transferring elements and the housing in which the heat transferring arrangement is to be inserted may be provided with a thermally conductive material in order to further improve the transfer of heat to the housing. Also, by providing a material also having low friction characteristics, the assembly of the heat transferring arrangement in the housing may be further improved and simplified as the second end portions of the elongated heat transferring elements may slide more easily against the inner surface of the housing compared to having end portions in the same material as the remaining elongated heat transferring elements. The thermal interface material may comprise graphite. The graphite material is well known and is easy to apply since it can have an adhesive side for attachment to the second end portion, is relatively conformable and may be arranged with a relatively low friction coefficient on the side facing the housing, while also having good thermal characteristics. Other materials, or combination of materials, are of course also conceivable. For example, the second end portion may be provided with a conformable thermal pad having a thin plastic film on one side, together forming a sticky side for attachment to the second end portion, and a low friction side for the sliding contact against the housing. Hence, any material or material combination that may act as a thermal interface material with a sticky side in contact with the second end portions and a low friction side adapted to be in slidable contact with the inner surface of the housing may be used.

According to another example embodiment, an interface between the first end portion of the elongated heat transferring elements and the centre portion of the heat transferring arrangement may be provided with a second thermal interface material. Hereby, the thermal conductive characteristics between the elongated heat transferring elements and the centre portion may be improved. The second thermal interface material may be different compared to the thermal interface material provided at the second end portions of the plurality of elongated heat transferring elements. The second thermal interface material may, for example, be a thermal grease or a phase change material. The invention is, however, not limited to the use of these materials and graphite may also be used due to its beneficial thermal conductive characteristics. However, as the first end portion is more or less tightly fixated to the centre portion as described above, there is hence no particular need of a material having a lower friction coefficient than the remaining parts of the elongated heat transferring elements.

Furthermore, an area of the centre portion may be smaller than an area of an LED module comprising the light emitting diode, wherein the LED module is adapted to be connected to the area of the centre portion. The area of the center portion should be interpreted as the area delimited by the boundaries formed by the first end portions of the elongated heat transferring elements. Hereby, when the LED module is connected to the centre portion by means of, for example, screws or the like, the LED module is pressing against the first end portions of the elongated heat transferring elements which thereby are flexing outwardly from the centre portion. An advantage is, at least, that an increased pressure will be provided between the second end portions of the elongated heat transferring elements and the housing when the heat transferring arrangement is arranged in the housing.

According to another example embodiment of the present invention, at least one of the elongated heat transferring elements may comprise elongated recesses extending from the second end portions in a direction towards the centre portion. An advantage is, at least, that the flexibility of the elongated heat transferring elements may be further improved. For example, in the case the housing to which the heat from the LED module is to be transferred is a glass housing, e.g. an MR16 Halogen reflector housing, the inner surface of such a housing may be double curved to form a parabolic reflector. Hereby, the elongated heat transferring elements may be aimed towards either a base or an optical exit window on the lighting assembly, for example, depending on whether the optical solution is a single collimator, multi-collimator, reflector, etc. and also depending on the available space within the glass housing. The elongated heat transferring elements having elongated recesses arranged thereto may thus, when inserted into the housing, touch the inner surface of the housing and hence conformably be in abutment with the double curved surface. Furthermore, the elongated heat transferring elements may each be provided with a plurality of elongated recesses. This may even further improve the flexibility. Also, a plurality of elongated recesses may reduce the plastic deformation of each elongated heat transferring element, thus increasing the possibilities of providing already used heat transferring elements into new housings, i.e. the recycling possibilities of heat transferring elements is increased. Further, reducing the plastic deformation may also increase the contact forces between the second end portions and the inner surface of the housing.

According to another example embodiment of the present invention, the elongated heat transferring elements may be formed by brushes having a heat conductive material. The wording "brushes" should be interpreted such that the elongated heat transferring elements are formed by brush-like straws, each transferring heat, generated by the LED module, to the housing. The brushes are advantageous since they may conform to almost any possible geometry configuration of the housing.

According to another aspect of the present invention there is provided a lighting assembly comprising at least one light emitting diode, the above described heat transferring arrangement, and a housing for receiving the heat transferring arrangement. The at least one light emitting diode may, for example, be a LED module.

Furthermore, the lighting assembly may further comprise a shaping element configured to receive light emitted by the light emitting diode and to provide a light beam according to a predetermined form. Still further, the shaping element may be at least one of a reflector, a collimator, or a lens. Hereby, the light emitted by the light emitted diode may be arranged in a specific desired form. Effects and features of this aspect are largely analogous to those described above in relation to the other aspects of the present invention.

According to an example embodiment, the lighting assembly may further comprise a pressure disc arranged on top of the heat transferring arrangement. Hereby, the pressure disc can be arranged to provide an extra pressure on the elongated heat transferring element, in order to further secure that the elongated heat transferring elements are in abutment with housing. This may be especially beneficial in a case where the heat transferring arrangement is made of a graphite material having less flexible properties than e.g. aluminum. However, a pressure disc may be beneficial for all material used for the heat transferring arrangement, not only graphite, since it provides for the extra contact pressure between the heat transferring arrangement and e.g. the inner surface of the housing. Accordingly, in such a case, the pressure disc provides a pressure on to the graphite heat transferring arrangement so that a relatively sufficient abutment between the heat transferring arrangement and the housing is achieved. Hereby, the transfer of heat from the centre portion towards the housing may be further secured. It should also be noted that the lighting assembly may comprise more than one heat transferring arrangement, such as e.g. two heat transferring arrangements positioned on top of each other. In such a case, the pressure disc may e.g. be provided in between the two heat transferring elements.

Furthermore, the lighting assembly may comprise a compressible pressure element, wherein the heat transferring arrangement is arranged between the housing and the compressible pressure element. The compressible pressure element may, for example, be a sponge-like disc which has a relatively soft surface in comparison with, for example, a pressure plate made of a metal material. An advantage is, at least, that pressure between the compressible pressure element and the heat transferring arrangement may be more uniformly applied since the sponge-like disc may smoothly conform to the elongated heat transferring elements of the heat transferring arrangement. Also, wear of the heat transferring element may be reduced in comparison to e.g. a metallic non-elastic pressure plate.

According to an example embodiment of the present invention, the lighting assembly may further comprise a heat sink plane located optically in the lighting assembly and configured to dissipate heat, generated by the at least one light emitting diode, in an optical direction of the lighting assembly. Accordingly, the heat sink plane can be located in an opposite direction compared to the normal heat dissipation direction of an LED lamp. The heat sink plane may be mechanically connected to e.g. the second end portions of the elongated heat transferring elements. This may be accomplished by, for example, providing the second end portions in abutment with the heat sink plane, bending or folding a portion of the second end portions around the heat sink plane, etc. Hereby, a further improvement in dissipating heat from the LED module may be achieved since heat may be transferred both to the housing and to the heat sink plane, where the heat thereafter is dissipated to e.g. the ambient air.

Further features of, and advantages with, the present invention will become apparent when studying the appended claims and the following description. The skilled addressee realize that different features of the present invention may be combined to create embodiments other than those described in the following, without departing from the scope of the present invention.

BRIEF DESCRIPTION OF THE DRAWINGS

These and other aspects of the present invention will now be described in more detail, with reference to the appended drawings showing example embodiments of the invention, wherein.

DETAILED DESCRIPTION

Figure 1:
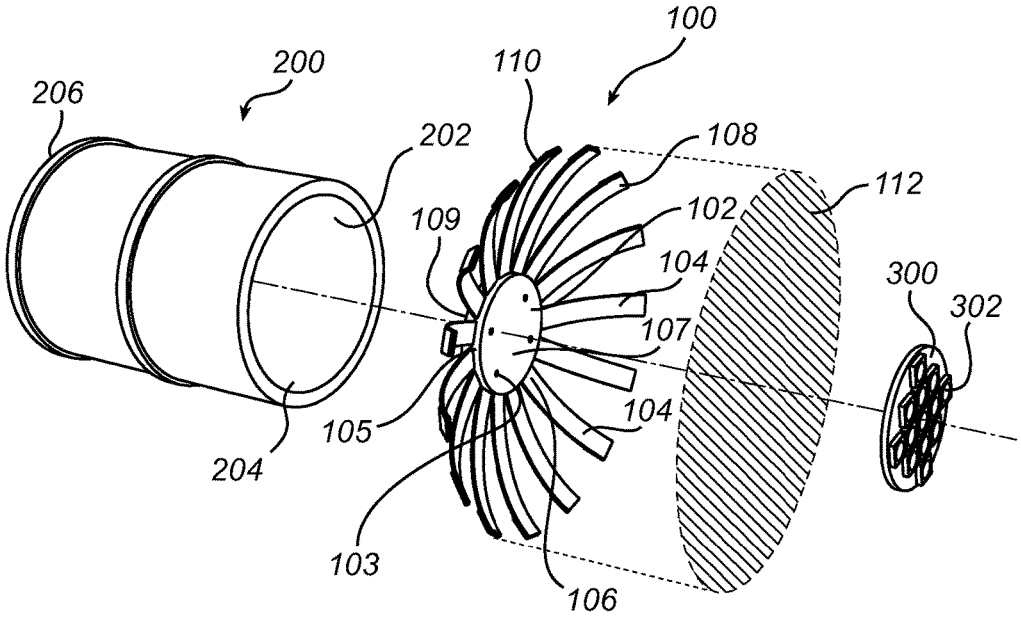
FIG. 1 illustrates a perspective view of a heat transferring arrangement and a housing prior to mounting according to an example embodiment of the present invention.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled addressee. Like reference characters refer to like elements throughout.

Figure 4:
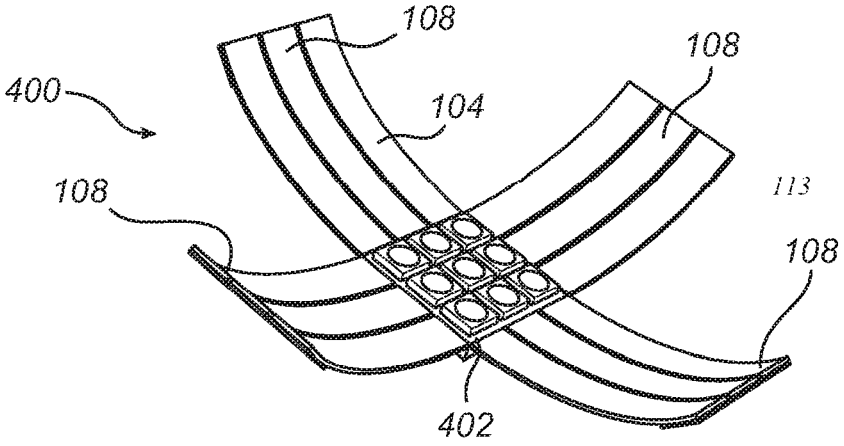
FIG. 4 illustrates a perspective view of another embodiment of the heat transferring arrangement according to the present invention.

Referring now to the drawings and to FIG. 1 in particular, there is depicted a perspective view of the heat transferring arrangement 100 prior to being inserted in a housing 200 according to a currently preferred embodiment of the invention. As is illustrated in FIG. 1, the heat transferring arrangement 100 comprises a centre portion 102. The centre portion 102 is configured for mounting a LED 302 or a LED module 300, in the illustrated embodiment the LED module 300 having LEDs 302 arranged thereto. The LED module 300 can be mounted to the centre portion 102 of the heat transferring arrangement 100 in a number of ways, such as by means of screws, bolts, an adhesive, et cetera. In the illustrated embodiment, the LED module 300 is arranged to be connected to the centre portion 102 by means of screws through corresponding screw holes 103 arranged in the centre portion 102. Furthermore, the heat transferring arrangement 100 comprises a plurality of elongated heat transferring elements 104, here illustrated as elongated fins or fingers extending from the centre portion 102 of the heat transferring arrangement 100, wherein each of the elongated heat transferring elements 104 having a first end portion 106 connected to the centre portion 102. In the embodiment illustrated in FIG. 1 each of the first end portions 106 of the elongated heat transferring elements 104 is connected to a lateral side 105 of the centre portion 102. However, the first end portions 106 of the elongated heat transferring elements 104 may be connected to an upper 107 or lower 109 side of the centre portion 102 as well. The first end portion 106 of the elongated heat transferring elements 104 may be connected to the centre portion in a number of ways and configurations. For example, the first end portion 106 may be connected by means an external fixating means, such as a screw connection, bolt connection, glue or welding, et cetera. Also, if the elongated heat transferring elements 104 are connected by an external fixating means, a thermal interface material 113 may be provided between the first end portion 106 of the elongated heat transferring elements 104 and the centre portion 102 in order to increase the thermal conductivity between these parts. A thermal interface material 113 is also shown in FIG. 4 between elongated heat transferring elements 104 and the centre portion 402. Moreover, the first end portion 106 of the elongated heat transferring elements 104 may also be integrated with the centre portion 102, i.e. the elongated heat transferring elements 104 and the centre portion 102 may be provided from the same sheet of material.

Furthermore, each of the elongated heat transferring elements 104 also comprises a second end portion 108 arranged at an opposite side of the elongated heat transferring elements 104 compared to the first end portion 106. In the example embodiment of FIG. 1, the second end portion 108 comprises a thermal interface material 110, here illustrated as graphite. The graphite material is arranged with a sticky side for connection to the second end portion 108 and an opposite side having lower friction characteristics compared to the portion of the elongated heat transferring elements 104 not provided with a thermal interface material. The side of the graphite having lower friction characteristics is arranged to be in connection with an inner surface 202 of the housing 200 when the heat transferring arrangement 100 is inserted in the housing 200, which will be further described below in relation to FIG. 2. Also, a geometric area 112 formed by boundaries delimited by the second end portions 108 of the elongated heat transferring elements 104 is, in the illustrated embodiment, larger than a cross-sectional area formed by the inner surface 202 of the housing 200 in which the heat transferring arrangement 100 is to be inserted. In the illustrated embodiment of FIG. 1, the geometric area has a circular shape but may of course have other forms as well, such as e.g. rectangular which will be described below in relation to FIG. 4.

Still further, according to an example embodiment of the present invention and as is illustrated in FIG. 1, the area of the LED module 300 which is arranged to be connected to the centre portion 102 of the heat transferring arrangement 100 may be larger than the corresponding area of the centre portion 102. Hereby, when the LED module 300 is connected to the centre portion 102, a peripheral part of the LED module 300 will be in abutment with the elongated heat transferring elements 104, thereby at least slightly bend them outwardly in relation to their original configuration. Hereby, a pressure is provided between the LED module 300 and the elongated heat transferring elements 104. According to another example, the centre portion 102 and the elongated heat transferring elements 104 may be provided from one and the same sheet of material.

Figure 2:
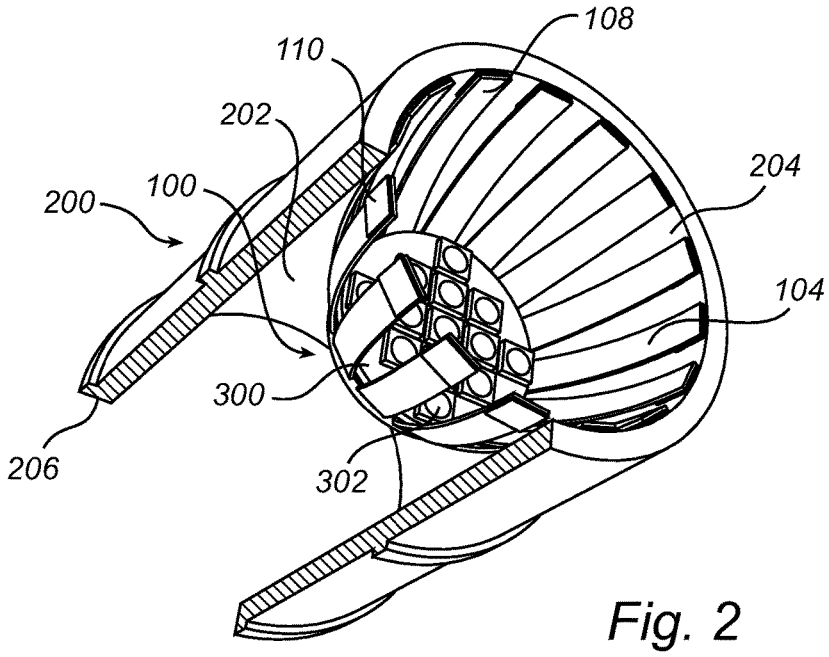
FIG. 2 illustrates a partially cross-sectional perspective view of the example embodiment of FIG. 1 in a mounted configuration.
Figure 3:
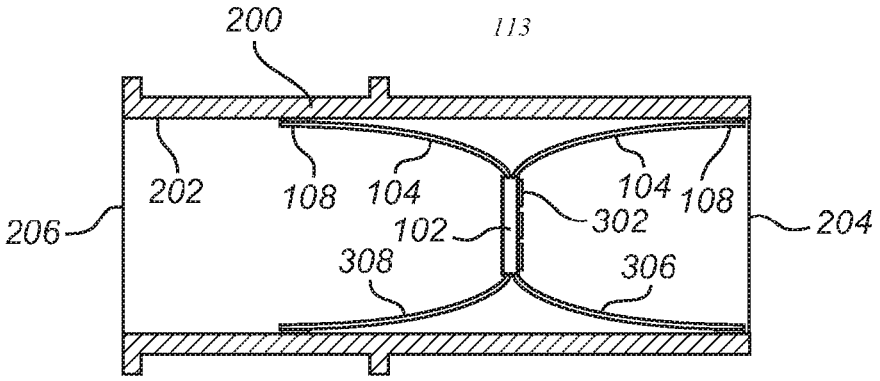
FIG. 3 illustrates a cross-sectional side view of a heat transferring arrangement having two layers of elongated heat transferring elements according to an embodiment of the present invention.

In order to describe the invention in yet more detail, the following description will mainly be focused on the elongated heat transferring elements 104. The elongated heat transferring elements 104 are, as described above, connected to the centre portion 102 of the heat transferring arrangement 100 and extend outwardly there from and, as illustrated in e.g. FIG. 1, in a direction which is approximately perpendicular to the surface of the centre portion 102 and directed towards an opening 204 of the housing 200 when mounted thereto, which is illustrated in FIG. 2. However, the elongated heat transferring elements 104 may just as well extend in the opposite direction (not illustrated here), i.e. towards a bottom portion 206 of the housing instead of towards the opening 204. Moreover, according to yet another example embodiment of the invention, as illustrated in FIG. 3, the heat transferring arrangement may also comprise two "layers" of elongated heat transferring elements 104, where the first layer 306 has an extension towards the opening 204 of the housing 200, and the second layer 308 has an extension towards the bottom portion 206 of the housing 200. Hereby, a larger heat transferring area between the second end portions 108 of the elongated heat transferring elements 104 and the inner surface 202 of the housing 200 may be achieved. Also, the fixation of the heat transferring arrangement 100 to the housing 200 may be simplified by having e.g. a recess or the like in the housing in which the second end portions 108 of the first 306 and/or second 308 layer may be connected to. It should be understood that the recess may just as well be replaced by an additional ring arranged on the inner surface 202 of the housing 200, wherein the second end portions 108 of the elongated heat transferring elements 104 may be in abutment with the ring. Furthermore, the elongated heat transferring elements 104 may preferably be made of a metal material which has a satisfactory heat conductive characteristic and not being too rigid, in order to be able to flex and bend when exposed to compression from the housing 200, which will be described further below in relation to the description of FIG. 2. Such material may, for example, be aluminum. Other alternatives are of course conceivable, such as e.g. copper, heat pipes, flat heat pipes, etc.

Reference is now made to FIG. 2 illustrating the heat transferring arrangement 100 having the LED module 300 connected to its centre portion 102 which is connected to the inner surface 202 of the housing 200 by means of the elongated heat transferring elements 104, thus forming a lighting assembly arranged to be inserted in e.g. a track luminaire, pendels, et cetera. When the LED module 300 has been connected to the centre portion 102, the outer periphery of the LED module 300 is in abutment with the elongated heat transferring elements 104 as described above. Hereby, a pressure is provided between the LED module 300 and the elongated heat transferring elements 104 in such a way that the elongated heat transferring elements 104 are at least slightly bended outwardly in relation to their original configuration. Moreover, as also described above, the geometric area 112 formed by the end portions 108 of the elongated heat transferring elements 104 is, in the illustrated embodiment, larger than a cross-sectional area of the inner surface 202 of the housing 200. Hereby, when the heat transferring arrangement 100 is inserted in the housing, as illustrated in FIG. 2, the second end portions 108, or more particularly, the thermal interface material 110 will slide against the inner surface 202 of the housing in such a way that the elongated heat transferring elements 104 will at least slightly bend inwardly, thereby providing a pressure between the second end portions 108 and the inner surface 202 of the housing 200. This pressure will, on the one hand, enable the heat transferring arrangement 100 to be relatively fixated to the inner surface 202 of the housing 200, and on the other hand provide a relatively secure thermal interface between the second end portions 108 and the inner surface 202. The heat transferring arrangement 100 may, however, also be connected to the housing 200 by other means than only the pressure between the second end portions 108 and the inner surface 202 of the housing 200, such as e.g. by means of an external screw joint or a hook, etc. Other alternatives are of course also conceivable such as a e.g. a ring arranged inside the elongated heat transferring elements 104 and adapted to apply pressure against the elongated heat transferring elements 104 in order to bend them outwardly so that an increased pressure may be provided between the second end portions 108 of the elongated heat transferring elements 104 and the inner surface 202 of the housing 200.

Furthermore, when the LED module 300 is fixated to the heat transferring arrangement 100, which is inserted in the housing 200, the LED module 300 is connected to an external power source (not shown here) in order to provide the LEDs 302 with power. The LEDs 302 may then transmit light in a direction towards the opening 204 of the housing 200. The heat generated by the LEDs 302 when emitting light is then transferred to the centre portion 102 of the heat transferring arrangement 100, i.e. released in an opposite direction compared to the light beams if the LEDs. Thereafter, the heat is transferred through the elongated heat transferring elements 104, which are in abutment with the inner surface 202 of the housing 200 as described above, such that the heat is further transferred from the elongated heat transferring elements 104 to the housing 200, via the second end portions 108. The heat received by the housing 200 is thereafter then released to the ambient environment, i.e. released from the lighting assembly. It should however be understood that the invention is not limited to a housing 200 releasing the heat directly to the ambient environment, the housing 200 may of course in turn be connected, directly or indirectly, to an external heat transferring element, such as for example a heat sink or the like, which in turn releases the generated heat.

Reference is now made to FIG. 4 illustrating another example embodiment of the heat transferring arrangement 400 according to the present invention. The heat transferring arrangement embodied in FIG. 4 has the same functionalities as the heat transferring arrangement previously described in relation to FIGS. 1 and 2, and those features and functionalities will not be described further if not indicated such. Now, as is illustrated in FIG. 4, the heat transferring arrangement 400, and in particular the centre portion 402 has a generally rectangular shape which is adapted to be connected to a generally rectangular shaped housing (not shown here). The centre portion 402 is provided with a plurality of elongated heat transferring elements 104 on each of its edges, here illustrated as three elongated heat transferring elements 104 situated on each of the edges of the centre portion 402. As described above, a geometric area delimited by the second end portions 208 may preferably be larger than a cross-sectional area of the inner surface of the housing. In the embodiment illustrated in FIG. 4, the geometric area is thus a generally rectangular area with each of its sides formed by the three end portions 208 of the elongated heat transferring elements 104.

Figure 5:
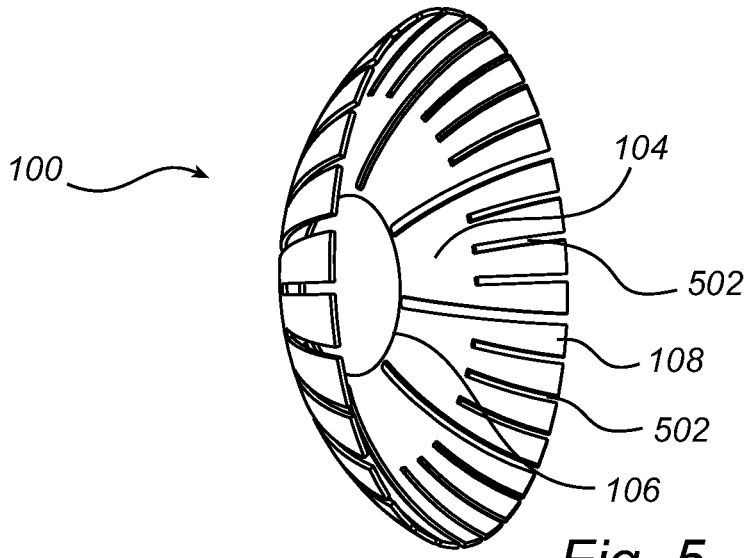
FIG. 5 illustrates an example embodiment of the heat transferring arrangement having recesses provided in the elongated heat transferring elements.
Figure 6:
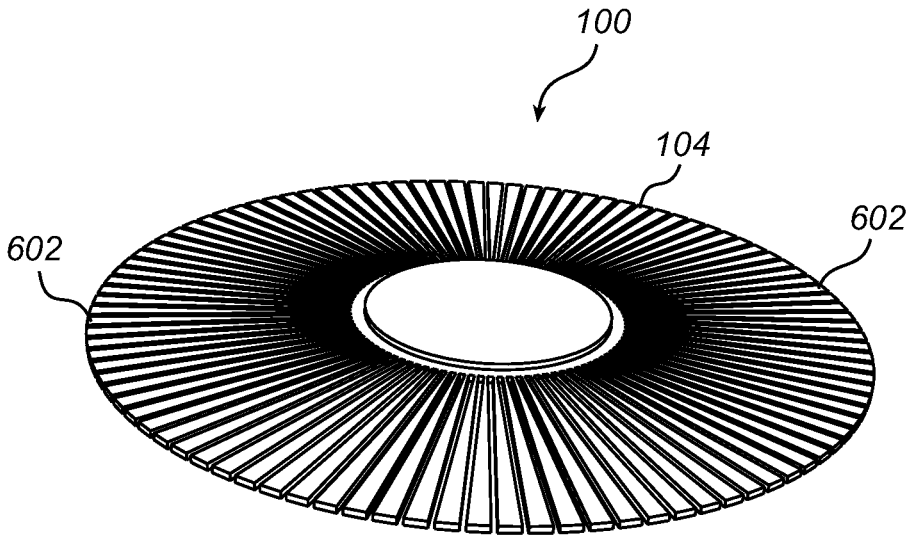
FIG. 6 illustrates an example embodiment of the heat transferring arrangement wherein the elongated heat transferring elements are formed by brushes.

According to still further example embodiments of the heat transferring arrangement 100, reference is now made to FIGS. 5 and 6. FIG. 5 illustrates an example embodiment of the heat transferring arrangement 100 according to the present invention, wherein the elongated heat transferring elements 104 are provided with elongated recesses 502. As is depicted in FIG. 5, the elongated recesses 502 are provided as cut-outs in the elongated heat transferring elements 104 and extend in a direction from the second end portions 108 towards the first end portions 106 of the elongated heat transferring elements 104. The number of elongated recesses 502 for each of the elongated heat transferring elements 104 may of course vary, and is dependent on, for example, the chosen initial width of the elongated heat transferring elements, the desired spacing of the cut-outs, the choice of material for the heat transferring elements and/or other relevant parameters.

Reference is now made to FIG. 6, illustrating yet another example embodiment of the heat transferring arrangement 100 according to the present invention. As is illustrated, the heat transferring arrangement 100 comprises a plurality of elongated heat transferring elements 104. The elongated heat transferring elements 104 are in the depicted heat transferring arrangement of FIG. 6 formed as a plurality of straws 602, which together forms a brush-like heat transferring element. The brush-like heat transferring element may be formed by a heat conductive material, such as aluminum, copper, graphite, etc. Also, the density of straws may of course vary and is dependent on the specific application, for example the design and geometry of the housing in which the lighting assembly, and hence the heat transferring arrangement 100 is to be placed.

Figure 7:
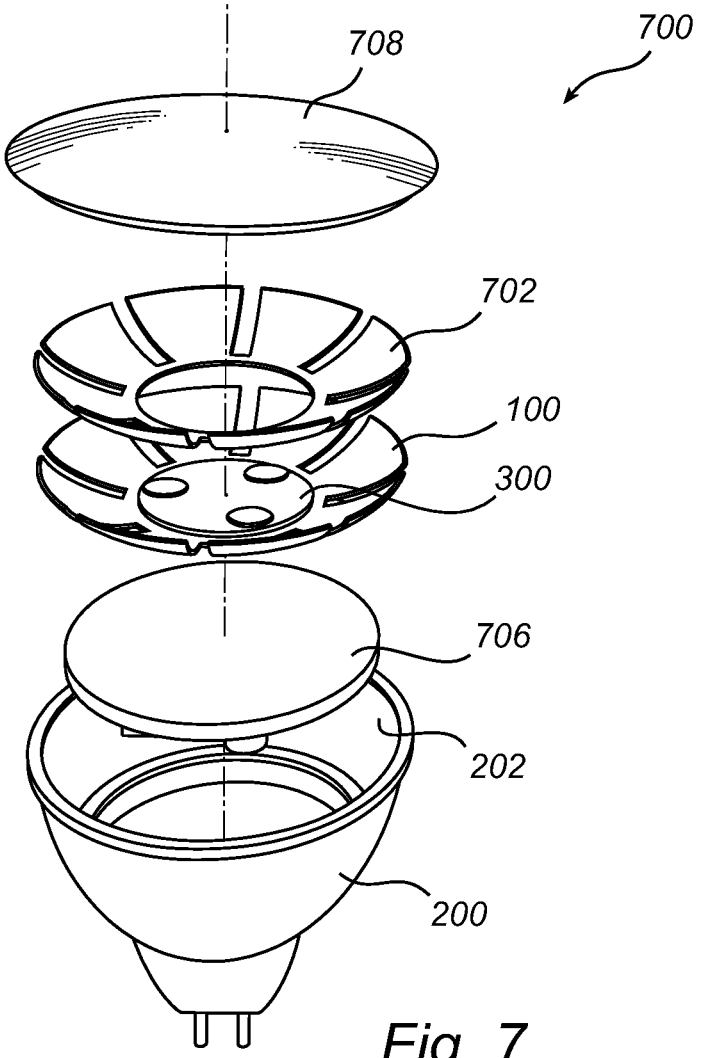
FIG. 7 illustrates an exploded perspective view of an example embodiment of the lighting assembly according to the present invention.
Figure 8:
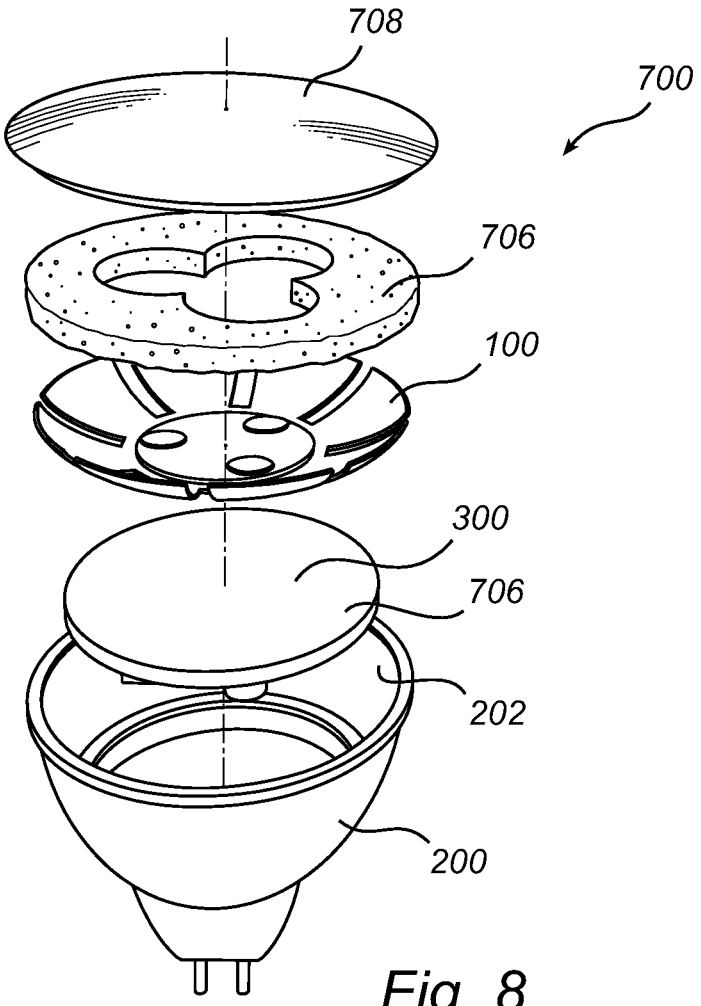
FIG. 8 illustrates an exploded perspective view of yet another example embodiment of the lighting assembly according to the present invention.
Figure 9:
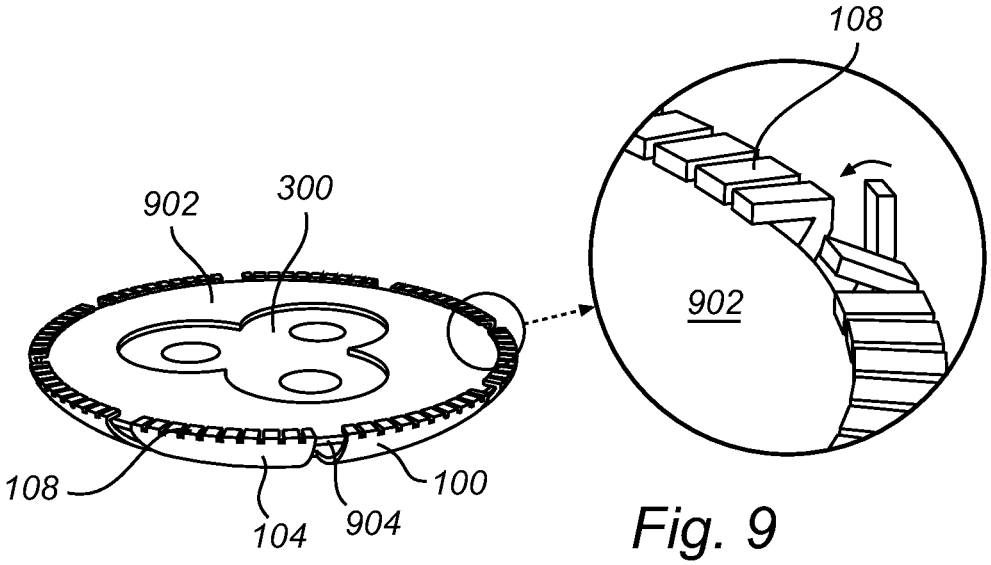
FIG. 9 illustrates a perspective view of an embodiment of a lighting assembly having a heat sink plane located optically in the lighting assembly.

Attention is now drawn to FIGS. 7-9, illustrating further example embodiments of a lighting assembly 700 according to the present invention. FIG. 7 illustrates an exploded perspective view of an example embodiment of the lighting assembly 700 according to the present invention. The lighting assembly 700 comprises a housing 200, an LED module 300 provided onto a driver 706 for electrically connecting the LED module 300, a heat transferring arrangement 100, a compression disc 702 and a collimator 708. When assembling the lighting assembly illustrated in FIG. 7, the heat transferring arrangement 100 is provided onto the driver 706. The LED module 300 is thereafter arranged on to the heat transferring arrangement 100 and electrically connected to the driver. The heat transferring arrangement 100 may be any of the above described heat transferring arrangements. The compression disc 702 is thereafter connected on top of the heat transferring arrangement 100 and the assembly constituted of the driver 706, LED module 300, heat transferring arrangement 100 and compression disc 702 is inserted into the housing 200 of the lighting assembly 700. The collimator 708 may thereafter be provided to the assembly in order to direct light emitted by the LED module in a desirable manner. Hereby, the heat transferring arrangement 100 is connected to the LED module 100 and the driver 706 and end portions of the heat transferring elements are in abutment with the inner surface 202 of the housing 200 so that heat generated by the LED module 300, when emitting light, can be transferred to the housing 200. It should however be noted that the assembling steps described above are merely an example, the steps of assembling the lighting assembly may of course be made in a number of ways and in different order compared to the description above.

Furthermore, the compression disc 702 is configured to provide an additional pressure onto the elongated heat transferring elements of the heat transferring arrangement 100 so that a sufficient pressure between the elongated heat transferring elements and the inner surface 202 of the housing 200 is achieved. More specifically, in a case where the heat transferring arrangement 100 is made of graphite, which is less flexible than e.g. aluminum, the compression disc 702 may be of particular importance in order to achieve a desirable contact between the elongated heat transferring elements and the inner surface 202 of the housing 200.

Although the embodiment depicted in FIG. 7 illustrates the heat transferring arrangement 100 to be positioned onto the driver 706, the heat transferring arrangement 100 may also be provided with a through hole, similar to the depicted compression disc 702. In such a case, the heat transferring arrangement may be positioned onto the LED module 300 such that the LED module 300 is directly positioned on the driver 706. Also, the invention is not limited to the use of one heat transferring arrangement 100 provided in the lighting assembly as depicted in FIG. 7, the lighting assembly may also comprise a second heat transferring arrangement 100 which e.g. may be positioned onto the compression disc 702, such that a heat transferring arrangement 100 is positioned on each side of the compression disc 702.

FIG. 8 illustrates an exploded perspective view of yet another example embodiment of the lighting assembly 700 according to the present invention. The main difference between the lighting assembly depicted in FIG. 7 and the lighting assembly illustrated in FIG. 8 is that the compression disc 702 in FIG. 7 is replaced by a compressible pressure element 706. The compressible pressure element 706 may, for example, be a sponge-like disc having a relatively soft surface in comparison to for example, a pressure plate made of a metal material. The compressible pressure element 706 may hence be arranged to provide a more or less uniform pressure onto the heat transferring arrangement 100 so that a sufficient pressure between e.g. the elongated heat transferring elements and the inner surface 202 of the housing 200 is achieved.

Moreover, the configuration of the lighting assembly 700 depicted in FIG. 8 may of course be arranged in the same manner as the different configurations described in relation to FIG. 7. Accordingly, the heat transferring arrangement 100 may, for example, be positioned onto the LED module 300 such that the LED module 300 is directly connected to the driver 706, etc.

FIG. 9 illustrates a perspective view of an embodiment of the present invention where a heat sink plane 902 is located optically in the lighting assembly. The housing 200 depicted in e.g. FIGS. 7 and 8 is omitted in FIG. 9 for illustrative purposes. In FIG. 9, the LED module 300 is arranged and connected to the heat transferring arrangement in accordance to one of the examples described above. The heat sink plane 902 is arranged in the heat transferring arrangement 100 in such a way that the circumferential distance of the heat sink plane 902 is slightly smaller than the circumferential distance formed by the end portions 108 of the heat transferring arrangement 100. Hereby, the heat sink plane 902 may be positioned within the heat transferring arrangement 100. Moreover, when the heat sink plane 902 is positioned within the heat transferring arrangement 100, the end portions 108 of the elongated heat transferring elements 104 are bended or folded at least partially around an edge 904 of the heat sink plane 902. The heat transferring arrangement 100 together with the heat sink plane 902 can thereafter be positioned within the housing 200. With this configuration, heat generated by the LED module 300 can be transferred both to the inner surface 202 of the housing 200 as described above as well as to the heat sink plane 902. Hereby, heat can also be dissipated in the optical direction.

Figure 10:
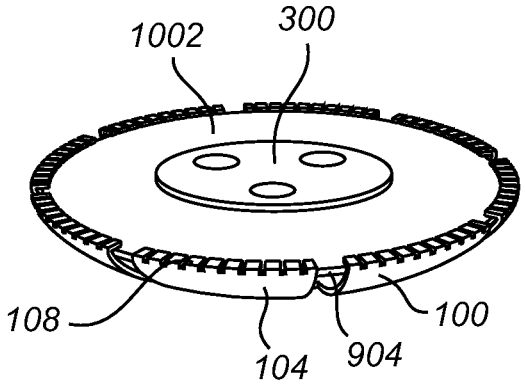
FIG. 10 illustrates a further embodiment of the heat sink plane in FIG. 9.

FIG. 10 illustrates another embodiment of the heat sink plane 1002. In the depicted embodiment of FIG. 10, the heat sink plane 1002 is substantially continuous and the LED module 300 is attached to the heat sink plane 1002, in comparison to the LED module 300 situated within the heat transferring arrangement 100 and heat sink plane 902 as depicted in FIG. 9. Hereby, heat generated by the LED module 300 is transferred through the heat sink plane 1002 and further to the end portions 108 of the elongated heat transferring elements 104. Heat is thereafter transferred to the inner surface 202 of the housing 200 on its path towards a centre portion of the heat transferring arrangement 100.

Variations to the disclosed embodiments can be understood and effected by the skilled addressee in practicing the claimed invention, from a study of the drawings, the disclosure, and the appended claims. For example, a centre portion of the heat transferring arrangement, for insertion in a generally rectangular shaped housing, may be circularly shaped having its elongated heat transferring elements in a generally rectangular shape instead of the circular shape described above. Furthermore, in the claims, the word "comprising" does not exclude other elements or steps, and the indefinite article "a" or "an" does not exclude a plurality.

The invention claimed is:

1. A lighting assembly, comprising:

at least one light emitting diode;

a housing; and a heat transferring arrangement configured to cool the at least one light emitting diode, and comprising:

a center portion configured to mount the light emitting diode and receive heat generated from the light emitting diode when emitting light, and a plurality of elongated heat transferring elements configured to be inserted into the housing, each element having a proximal first end portion connected to the center portion and a distal second end portion configured to be in abutment with an inner surface of the housing, so that the generated heat is thermally transferred to the housing, wherein an outer surface of the distal second end portion abuts the inner surface of the housing, a first layer of the elongated heat transferring elements extending towards an opening of the housing, and a second layer of the elongated heat transferring elements extending towards a direction opposing the opening of the housing, wherein each of the distal second end portions of the plurality of elongated heat transferring elements comprises a thermal interface material having a friction coefficient, and wherein the friction coefficient of the thermal interface material is lower than that of a remaining portion of the elongated heat transferring elements not provided with a thermal interface material, further comprising a heat sink plane located optically in the lighting assembly and configured to dissipate heat, generated by the at least one light emitting diode, in an optical direction of the lighting assembly, wherein a circumferential distance to the heat sink plane is smaller than a circumferential distance defined by the second end portions of the flexible elongated heat transferring elements, and wherein each of the second end portions are separated from adjacent second end portions by a recess and is bent or folded at least partially around an edge of the heat sink plane.

* * * * *